US005713327A

United States Patent [19]

Tilton et al.

[11] Patent Number: 5,713,327

[45] Date of Patent: Feb. 3, 1998

[54] LIQUID FUEL INJECTION DEVICE WITH PRESSURE-SWIRL ATOMIZERS

[76] Inventors: Charles L. Tilton; Donald E. Tilton; Bruce A. Smetana, all of P.O. Box 69, Colton, Wash. 99113-0069

[21] Appl. No.: 778,879

[22] Filed: Jan. 3, 1997

[51] Int. Cl.[6] ..... F02B 3/00

[52] U.S. Cl. ..... 123/299; 239/473

[58] Field of Search ..... 239/437, 473, 239/551; 251/208, 209; 123/298, 299, 301, 305

[56] References Cited

U.S. PATENT DOCUMENTS

| | | | |
|---|---|---|---|
| 2,592,111 | 4/1952 | Bischof | 299/107.4 |
| 4,226,365 | 10/1980 | Norris et al. | 239/551 |
| 4,452,396 | 6/1984 | Cataldo | 239/223 |
| 4,524,913 | 6/1985 | Bron | 239/222.17 |
| 4,566,634 | 1/1986 | Wiegand | 239/410 |
| 4,796,816 | 1/1989 | Khinchuk | 239/501 |
| 4,869,429 | 9/1989 | Brooks et al. | 239/473 |
| 4,919,093 | 4/1990 | Hiraki et al. | 123/299 |
| 4,970,865 | 11/1990 | Shekelton | 60/757 |
| 4,979,479 | 12/1990 | Furukawa | 123/472 |
| 4,982,716 | 1/1991 | Takeda | 239/533.12 |
| 5,058,549 | 10/1991 | Hashimoto et al. | 123/298 |
| 5,062,573 | 11/1991 | Makimura | 239/533.12 |
| 5,199,398 | 4/1993 | Nylund | 123/299 |
| 5,201,299 | 4/1993 | Kong | 123/527 |
| 5,282,577 | 2/1994 | Neitz | 239/533.4 |
| 5,326,073 | 7/1994 | Beyer et al. | 251/209 |
| 5,435,288 | 7/1995 | Schmal | 123/527 |
| 5,452,857 | 9/1995 | Furuse et al. | 239/473 |

FOREIGN PATENT DOCUMENTS

| | | | |
|---|---|---|---|
| 2358993 | 5/1974 | Germany | 239/437 |
| 2855906 | 7/1990 | Germany | 239/437 |

*Primary Examiner*—Thomas N. Moulis
*Attorney, Agent, or Firm*—Keith S. Bergman

[57] ABSTRACT

A liquid fuel injection device for internal combustion engines provides an elongate peripheral injector housing defining a cylindrical medial chamber with a fluid plenum having a fluid inlet at a first end and plural fluid exit ports at a second end that is carried within a combustion chamber of an engine cylinder. The plural exit ports are spacedly arrayed in both circumferential and axial directions and may be angularly oriented in the injector housing. The medial chamber of the injector housing rotatably carries an atomizer casement defining an internal chamber with plural circumferentially spaced inlet orifices at a first end which communicates with the fluid plenum of the first end of the injector housing and plural spray orifices at the second end. Each spray orifice of the atomizer casement carries a pressure swirl atomizer with output orifice arrayed to communicate with at least one of the exit ports defined in the second end of the injector housing at at least one rotary position of the atomizer casement relative to the injector housing. A first species of injection device provides electrically powered mechanism for rotating the atomizer casement relative to the injector housing and a second species provides pressurized fuel powered mechanism for such rotation. Both species allow adjustment of fuel injection timing and flow rate independently of each other.

5 Claims, 3 Drawing Sheets

LIQUID FUEL INJECTION DEVICE WITH PRESSURE-SWIRL ATOMIZERS

BACKGROUND OF INVENTION

1. Related Applications

There are no applications for patent related hereto heretofore filed in this or any foreign country.

2. Field of Invention

This invention relates generally to liquid fuel injection devices for internal combustion engines, and more particularly to such a device that has plural pressure swirl atomizers and rotary valving for independent adjustment of injection timing and flow rate.

3. Background and description of Prior Art

Liquid fuel injection systems have long been known and used to increase the efficiency of internal combustion engines. In such systems, volatile liquid fuels are atomized into a finely divided spray of small droplets upon being introduced into the combustion space. The fuel injection process is important in determining the nature of the subsequent combustion because the combustion reaction is quite dependent upon the homogeneous mixture of fuel and air and the gasification of fuel droplets in the combustion space. The efficiency of the combustion process in engines in the present day has assumed greater importance than in the past and will continue to do so because of the diminishing quality of fuels and the increasing environmental concerns about and regulation of exhaust pollutants released into the ambient atmosphere by inefficient combustion reactions.

Liquid fuel injectors generally, for economic success and commercial viability, must provide uniform atomization over a wide range of fluid flows, rapid response to changes in fluid flow rate, low power consumption, capability for design flexibility, low susceptibility to blockage by fuel contaminants and low build up of combustion materials on nozzle faces, aside from traditional commercial factors of low-cost, light-weight, reliability and ease of maintenance.

The use of fuel injectors in diesel engines is further complicated by the nature of the diesel combustion cycle which requires the injection and atomization of fuel in a high pressure environment. Notwithstanding the long history involving fuel injection systems for diesel engines, the substantial knowledge that has been developed concerning such devices and the many and various approaches to atomizers, including rotary, air assist, air blast, effervescent, electrostatic, ultrasonic and pressure types, many problems still remain. Because of these problems diesel engines remain about twice as heavy as naturally aspirated gasoline fueled engines of the same power output. The principal reason for this is poor fuel-air mixing which requires diesel engines to operate on very lean fuel mixtures that necessarily require an engine which is large and heavy for its power output. The instant invention seeks to provide a new and improved injector that lessens or resolves various of these problems not resolved by prior injection devices.

The traditional and most generally used type of fuel injector employs plain orifice atomization wherein a low viscosity liquid is passed through a small circular hole under pressure which exceeds the combustion chamber pressure by a sufficient amount, about twenty thousand pounds per square inch, so that the emerging fluid jet will disintegrate into an atomized spray. The physical reactions involved have been extensively studied but notwithstanding there is no general agreement on the detailed nature of this atomization process, though undoubtedly the process involves turbulence or unstable vibrations at the interface of an emerging fluidic jet and the surrounding gaseous atmosphere, whether this occurs within a nozzle, at its orifice or spacedly outwardly from the orifice. Regardless of the detailed nature of the physical reactions involved in the atomization process, plain orifice atomizers have fundamental limitations of low dispersement cone angles and long jet breakup lengths, both of which may be somewhat alterable but remain in their essence in all such devices, with dispersement cone angles usually not surpassing about fifteen degrees, even at very large Reynolds numbers. With such narrow dispersement cone angles, and notwithstanding a plurality of nozzles, generally fuel cannot be operatively delivered homogenously to an entire combustion chamber volume and the inherent limitations of time and distance required to develop instabilities that cause atomization merely accentuate this problem. It thusly appears that with plain orifice atomizers the essential nature of their operation requires that a fuel-air mixture in a combustion chamber will remain non-homogeneous with both fuel rich and fuel lean areas simultaneously existing within a cylinder.

The instant invention changes the atomization mechanism to circumvent the limitations of plain orifice atomization and provide a quantum rather than merely an incremental improvement in performance. The instant fuel injector embodies plural miniature pressure swirl type atomizers which allow control of flow rate, cone angle, cone shape and average droplet diameter over wide ranges of variation by determination of the pressure swirl nozzle design parameters. This type of injector allows substantially reduced injection pressures, provides uniform fuel and air mixing throughout a combustion chamber, flexible operation and reduced costs.

Though the pressure swirl atomizer is conceptionally simple, it differs essentially from the plain orifice atomizer. The plain orifice atomizer discharges fluid with an axial velocity, whereas the pressure swirl atomizer imparts a radial component to the discharging fluid which causes the fluid stream to disintegrate into droplets immediately upon discharge from an orifice. The droplets from the pressure swirl atomizer not only are created instantaneously at the injection orifice, but also may be up to ten times smaller and one thousand times more numerous than the drops produced by a plain orifice atomizer at a spaced distance from an orifice and operating at twice the pressure. Since droplet evaporation rate is proportional to the square of the droplet diameter, a one hundred fold reduction in fuel evaporation time is thus possible.

Various of the prior injection devices generally described are shown in the patent literature.

A plain orifice injection nozzle for an internal combustion engine providing a somewhat hemispherical tip, that defines a plurality of injection holes in circumferentially and radially spaced patterns with varying angularity, is shown in U.S. Pat. No. 4,919,093. Aside from the traditional problems described for plain orifice injectors, this device upon completion of the injection process leaves appreciable fuel inside the tip of the nozzle and this fuel will emerge during the low pressure cycle in a cylinder and will either not be burned or at least will be only partially burned, so as to create combustion pollutants that adversely affect emission quality.

A plain orifice air compression nozzle for fuel injection into an internal combustion engine is shown in U.S. Pat. No. 4,650,121. A nozzle needle is guided in the nozzle body to lift from a conical valve seat opposite the fuel flow direction and against the bias of a spring to allow injection. Swirl channels are arranged in the nozzle body upstream of the conical valve seat in a pressure space. This reference provides relatively good atomization by using a nozzle that creates a swirl, but the injector is limited to single jet nozzle applications. The jet cone from this nozzle is approximately twenty to forty degrees and will not provide either a spray distribution or a flow adjustment that are achievable with the multiple swirl atomizers of the instant injector.

An injector device for diesel engines shown in U.S. Pat. No. 4,566,634 provides a nozzle body with a movable valve needle. The nozzle body is surrounded by an ejector apparatus that has a suction chamber with an ejector duct from the suction chamber to the fuel chamber and an air intake duct. Fuel is injected under high pressure into the injector space and then into the combustion chamber. While the ejector reduces the amount of deleterious emission build up on the nozzle, it requires increased cost and creates manufacturing difficulty with relatively little improvement in spray quality or distribution. As in general with this type of plain orifice atomizer, the spray is relatively course and the spray cone angle is relatively narrow.

An ultrasonic fuel injecting nozzle is shown in U.S. Pat. No. 4,702,414 to comprise an ultrasonic generating device powering a vibrating element. When the amplitude of the vibrating element surface increases to the point where wave crests in the fluid become unstable and collapse, a mist of droplets is ejected from the surface. Traditionally ultrasonic atomizers have been used for applications requiring atomization of only small amounts of liquid such as in coating operations, spray drying, pharmaceutical and lubricating processes. The use of ultrasonic injection for larger volumes of liquid fuel is not particularly practical and such devices are not in widespread commercial use for this purpose at the present time.

A fuel injection valve with a pressurized air mechanism and an impingement surface is shown in U.S. Pat. No. 4,982,716. The injection valve includes an injector body defining a plain orifice injection hole with two injected fuel paths. The air assisting structure provides pressurized air to assist disintegration of the liquid jets from the fuel injection holes and a medial impingement surface which further aids the atomization. This type of injector requires small amounts of air at high velocities and is limited by low air velocities associated with low speed operations. With such an injector device, a large amount of power is devoted to pressurizing atomizing air to make the method fairly uneconomical.

Other fuel injector devices utilizing impingement surfaces for spray enhancement are seen in U.S. Pat. Nos. 4,979,479, 5,062,573, 4,796,816 and 4,970,865. In general these fuel injectors are provided with a surface upon which the pressurized fuel collides to produce a flat spray or a spray with large dispersement cone angles. The spray from such devices is coarse and the larger droplets and their poor distribution tend to leave unburned fuel and produce various nitrogen oxides associated with combustion of a lean fuel mixture, both of which contribute to engine exhaust pollution.

The instant device differs from this prior art by utilizing a rotary valving structure and multiple pressure swirl atomizers through which fuel dispersement is independently adjustable. The atomizers provide uniform atomization and improved spray distribution over a wide range of liquid flow rates, operate at a lower pressure differential than other atomizers, require less power, are of lower cost, produce smaller droplet sizes sooner in the combustion cycle and reduce deleterious exhaust emissions. The atomizer casement rotating in the injector housing provides valving means which allow independent adjustment of the timing and flow rate of the output of the various swirl atomizers.

Our invention resides not in any one of these features individually, but rather in the synergistic combination of all of the structures of our injector which necessarily give rise to the functions flowing therefrom.

SUMMARY OF INVENTION

Our fuel injection device provides an elongate peripherally defined injector housing having a first end portion carried in a combustion chamber of an engine cylinder. The injector housing defines a cylindrical internal chamber carrying in immediate adjacency for rotary valving an elongate atomizer casement defining a medial fuel chamber. The atomizer casement defines in a first end portion a plurality of atomizer ports each carrying a swirl atomizer and communicating by an output channel with the chamber defined in the first end portion of the fuel injector housing. The fuel injector housing in its first end portion defines a plurality of axially and circumferentially spaced exit ports so arrayed that at least one exit port will be in coincidence with at least one output channel of each atomizer port when the injector housing and atomizer casement are in at least one rotary relationship. The second end portion of the injector housing defines a plenum for input of pressurized fluidic fuel into a plurality of spaced input orifices defined in the second end portion of the atomizer casement and contains a mechanism for rotating the atomizer casement within the injector housing.

The atomizer casement is rotated within the injector housing chamber in a synchronous manner relative to operation of a piston of an associated cylinder, in a first species by mechanical linkage powered by pressurized fuel in the injector housing and in a second species by an electrically powered motor.

In providing such a device, it is:

A principal object to provide a rotary valved, multi-port fuel injector having pressure swirl atomizers that provides uniformly fine atomization and improved spray distribution over a wide range of fuel flow rates to reduce undesirable combustion emissions, improve fuel economy, reduce combustion noise, and reduce power demands on the fuel delivery system.

A further object is to provide such an injector wherein spray droplets are formed sooner and at a shorter distance from spray exit orifices than are droplets formed by a plain orifice injector, so that the fuel spray jets exiting from the instant device do not impinge on a cylinder wall before atomization takes place.

A further object is to provide such an injector that allows timing and flow rate adjustments for individual exit ports, both of which adjustments are determined by the relative rotary positions of the spray atomizer output channels and exit ports of the injector housing and are independent of each other.

A further object is to provide such an injector that produces a spray with a homogeneous mixture of air and fuel droplets in a combustion chamber to reduce combustion emissions of nitrogen oxides, incompletely oxidized hydrocarbons and other exhaust pollutants.

A still further object is to provide such an injection device that produces fuel droplets about one-tenth the size of droplets produced by plain orifice atomizers of prior injectors to substantially increase the evaporation rate of droplets of liquid fuels and provide resulting higher rates of cleaner combustion.

A still further object is to provide such an injector that uses pressure swirl atomizers that require relatively low differential pressures for spray dispersement to eliminate higher pressures and higher power demands on the fuel delivery system for injection of fuel into a high pressure fuel chamber.

A still further object is to provide such an injector that is of new and novel design, of rugged and durable nature, of simple and economic manufacture and one that is otherwise well suited to the uses and purposes for which it is intended.

Other and further objects of our invention will appear from the following specification and accompanying drawings which form a part hereof. In carrying out the objects of our invention, however, it is to be understood that its features are susceptible to change in design and structural arrangement with only preferred and practical embodiments of the best known modes being illustrated in the accompanying drawings and specified as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
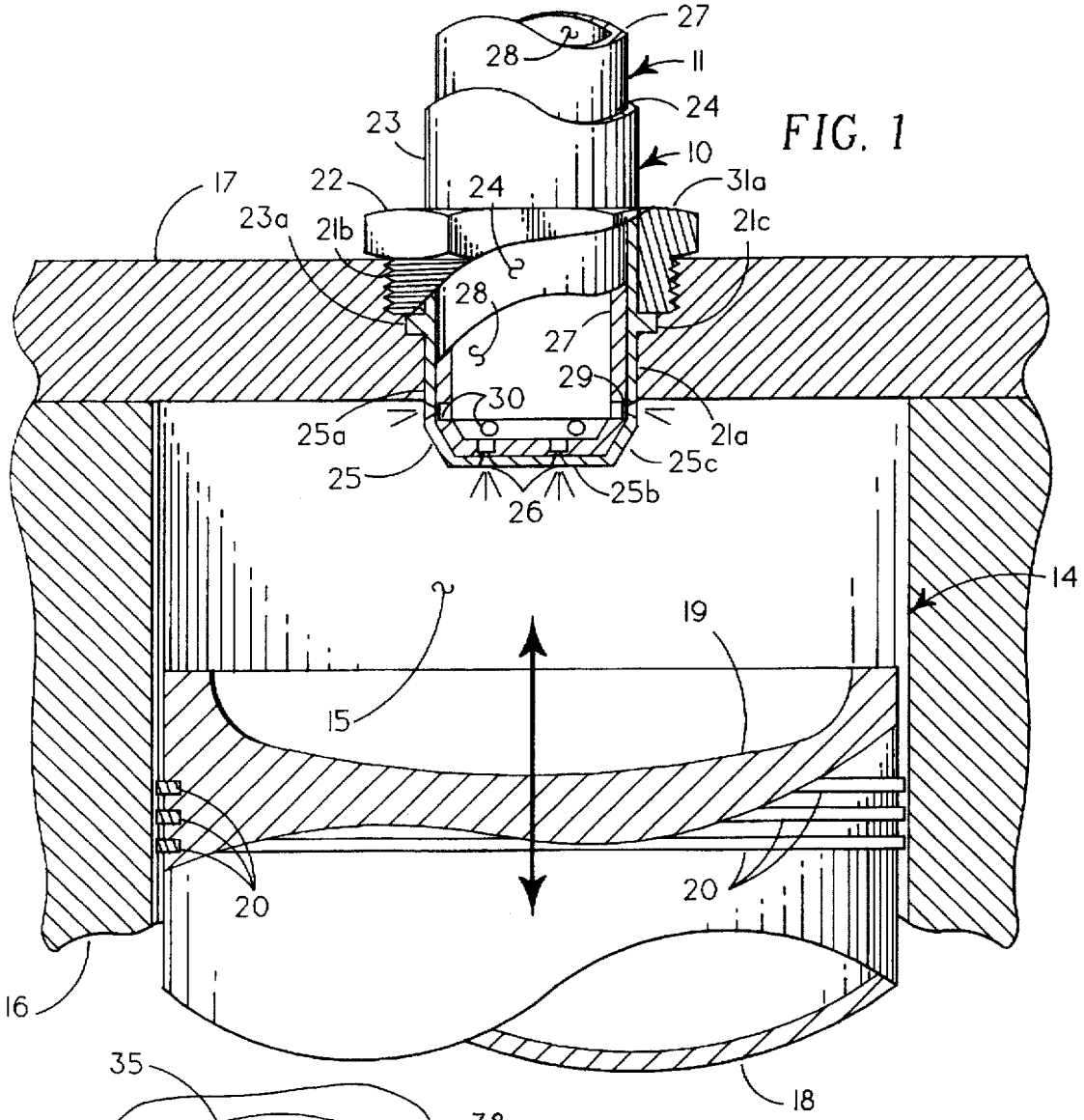
FIG. 1 is a somewhat idealized, partially cut-away view of an injector nozzle of our invention in place in the head of a cylinder of an internal combustion engine.

Our invention generally provides elongate injector housing 10 defining a cylindrical chamber rotatably carrying atomizer casement 11, powered for rotation in a first species by electrical linkage 13 and in a second species by hydraulical linkage 12, to inject pressurized fuel into motor cylinder 14.

A typical diesel engine cylinder embodying our fuel injection device is shown in FIG. 1. The cylinder 15 is defined in engine block 16 and covered in its upper part by cylinder head 17. The cylinder 15 carries piston 18, having complexly configured upper surface 19 and plural spaced piston rings 20 about its upper cylindrical periphery, for reciprocating vertical motion in the cylinder. The cylinder head 17 defines fuel injector port 21 having a diametrically small lower portion **21*a* and diametrically larger, internally threaded upper portion 21*b* with annular sealing channel 21*c* therebetween. Injector fastening plug 22 has medial threaded portion 22*a* to fastenably engage in upper portion 21*a* of the fuel injector port with its lower portion adjacent the inner surface of sealing channel 21*c* to releasably fasten and seal the lower portion of injector housing 10 in the fuel injector port. Normally, but not necessarily, the fuel injector port 21 will be positioned in an axially aligned orientation relative to the cylinder 15** as illustrated, though asymmetrical positioning of the injector in the head as heretofore known is operative with our invention and is within its ambit and scope.

A somewhat idealized form of our injector is shown in FIG. 1 where it is seen to comprise injector housing 10 formed by elongate tubular body 23 defining circularly cylindrical internal chamber 24, with lower nose portion 25 projecting within the upper medial area of cylinder 15. The tubular body spacedly inwardly of nose 25 defines annular, radially protruding fastening band **23*a* to cooperate with fastening plug 22 to sealably fasten the injector housing in sealing channel 21*c* of injector port 21 of the cylinder head. The nose portion 25** may assume various configurations from a simple right circular cylinder through the beveled nose illustrated to a hemispherical or other more complex curvilinear shape (not shown) to allow angulation of exit ports to various extents, but in general the beveled type nose shown allows exit port angulation to the greatest extent that has any practical utility and an ordinary right cylindrical nose portion fulfills most practical needs.

The nose portion 25 defines plural exit ports 26 in its side wall **25*a*, beveled portion 25*c* and bottom portion 25*b*. The exit ports 26** illustrated are outwardly flaring truncated conic channels extending perpendicularly to the surfaces of the injector housing in which they are defined, though they are not limited to this orientation and may either be angulated to the surface of the body defining them or they may be of other than conical shape. The configuration and array of these exit ports relates to the adjustability of the injector system and the shape of dispersement spray cones as discussed hereinafter.

The injector housing 10 carries circularly cylindrical atomizer casement 11 for rotation in immediate adjacency in its internal chamber 24, so that the structures create a valving action therebetween when the atomizer casement rotates relative to the injector housing. The atomizer casement 11 is formed by body 27 defining internal fuel chamber 28, generally, though not necessarily, of a similar circularly cylindrical cross-section. The body 27 defines a nose portion similar to the nose portion of the injector housing to provide an appropriate conformal fit between the members in the nose area. The external dimensions of body 27 of the atomizer casement are incrementally smaller than the corresponding internal dimensions of body 23 of the injector housing to allow the relative rotation of the two members but yet provide the valving action required between them.

The injector casement body 27 defines plural atomizer ports 29 communicating from its chamber 28 through its radially exterior surface. Each of these atomizer ports 29 are positioned in spacedly arrayed relationship so as to be coincident, or at least communicate with, exit ports 26 defined by the nose portion 25a of the injector housing when the injector housing body 23 and atomizer casement body 27 are in at least one particular rotary relationship. When these members are in such rotary relationship that the exit ports 26 and atomizer ports 29 communicate, pressurized fluid will pass from the internal chamber 28 of the atomizer casement through both ports 26, 29 exteriorly of injector housing 10 and into motor cylinder 15 to provide the valving action required of the injector. The atomizer ports 29 generally are axially and peripherally coincident in their orientation when aligned with the exit ports 26 defined in the injector housing, though they also may be angulated other than perpendicularly to the surfaces of the member in which they are defined and may have cross-sectional shapes other than circular, especially elongate slot-like configurations in the direction of rotation of the orifices.

Figure 2:
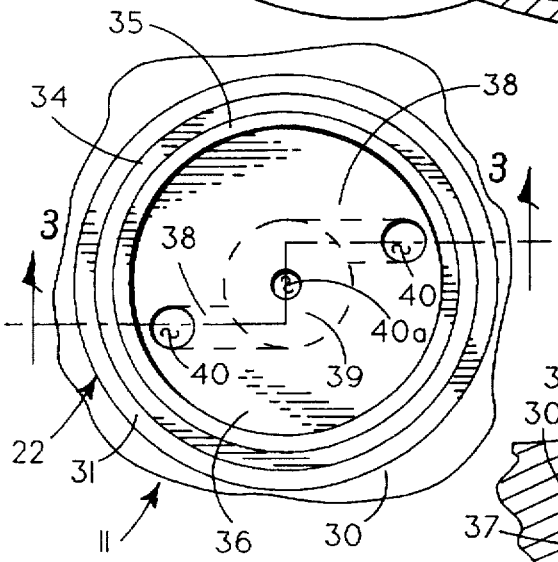
FIG. 2 is a substantially enlarged orthographic top view of a swirl-type injector nozzle of the injection device of FIG. 1.
Figure 3:
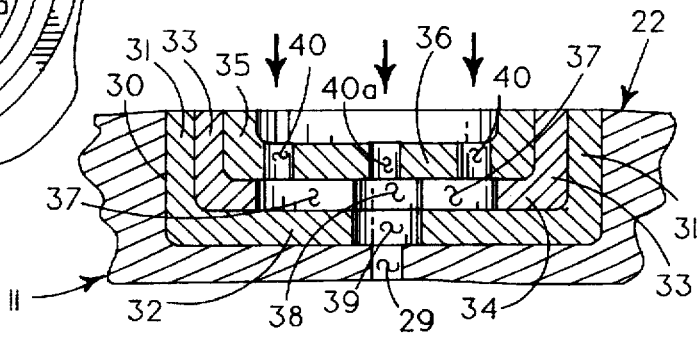
FIG. 3 is an offset medial cross-sectional view through the swirl injector nozzle of FIG. 2, taken on the line 3—3 thereon in the direction indicated by the arrows.

Each atomizer port 29 in its inner portion defines an enlarged hole 30 extending radially outwardly from the inner surface of the atomizer casement to receive a swirl atomizer, in the instance illustrated in a pressed fit. The particular swirl atomizer illustrated in FIGS. 2 and 3 is one formed by three separate interfitting parts that have orifices defined by chemical forming methods for ease and simplicity of manufacture. The atomizer provides tubular body element 31 having bottom portion 32 defining output chamber 39 communicating with atomizer port 29. The body element 31 carries in its medial channel tubular swirl arm element 33 having bottom portion 34 defining swirl arm chamber 38 extending therethrough to communicate with the output chamber 39. The swirl arm chamber 38 in the instance illustrated defines two opposed tangentially extending swirl arms 37 communicating with the medial cylindrical swirl chamber. The swirl arm element 33 carries in its medial channel tubular input element 35 having bottom portion 36 defining two lateral generally larger input channels 40 to communicate with the outer portions of swirl arms 37 and a medial generally smaller input orifice 40a communicating with the medial portion of swirl arm chamber 38.

This particular swirl atomizer illustrated and described is only one of various types of such devices that has been found useful in our injector because of its ease of manufacture in small sizes at low cost, but other known types of such atomizers having greater or lesser numbers of input arms, variously configured swirl chambers, variously configured output chambers and various methods of fastening for positional maintenance are within the ambit and scope of our invention and may be used with it, if not so effectively.

For operation of our fuel injector the atomizer casement 11 must be rotated relative to the injector housing 10 to provide necessary valving action for the device. The powering of the atomizer casement for rotation may be accomplished by various methods, such as by direct mechanical linkage to components of an engine being serviced (not shown), self-contained electric means as provided in a first species of our injector and pressurized fuel operated means as provided in a second species of our invention.

Figure 4:
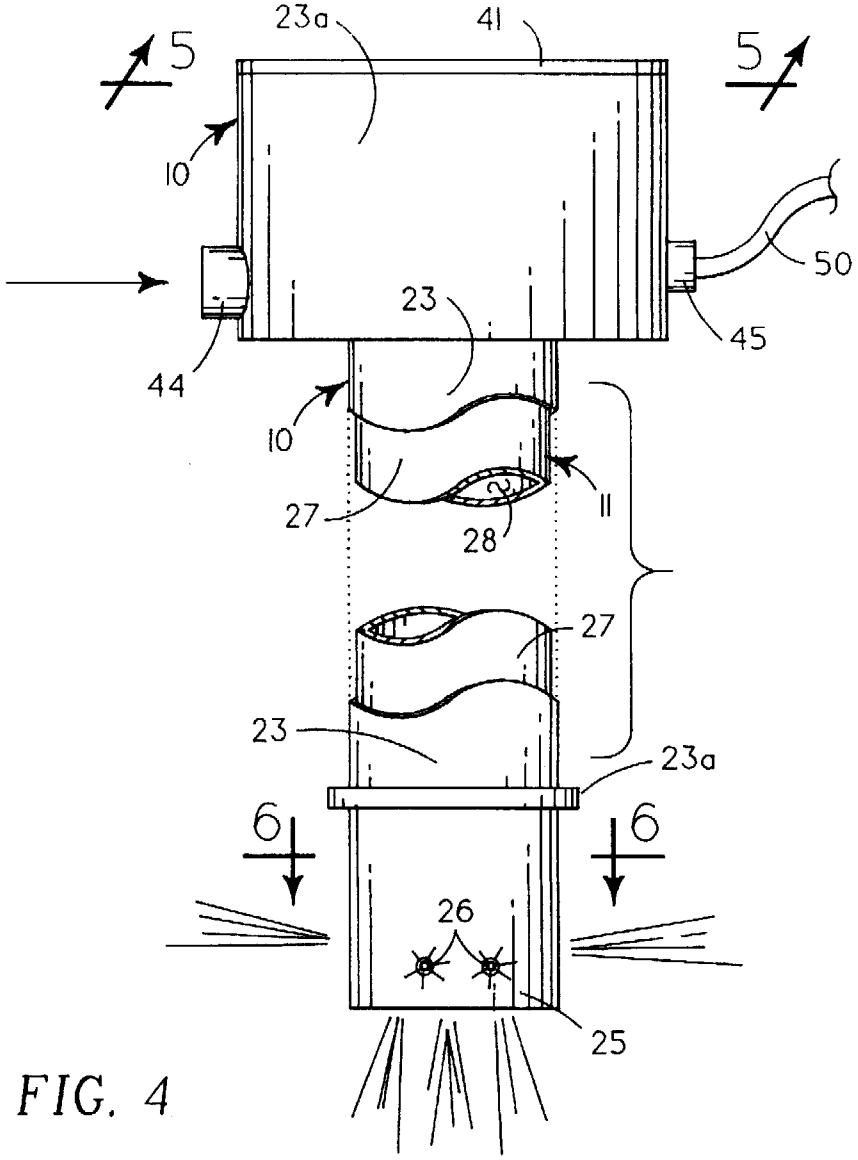
FIG. 4 is a partially cut-away orthographic view of an electrically powered species of injector device isolated from any associated engine structure.
Figure 5:
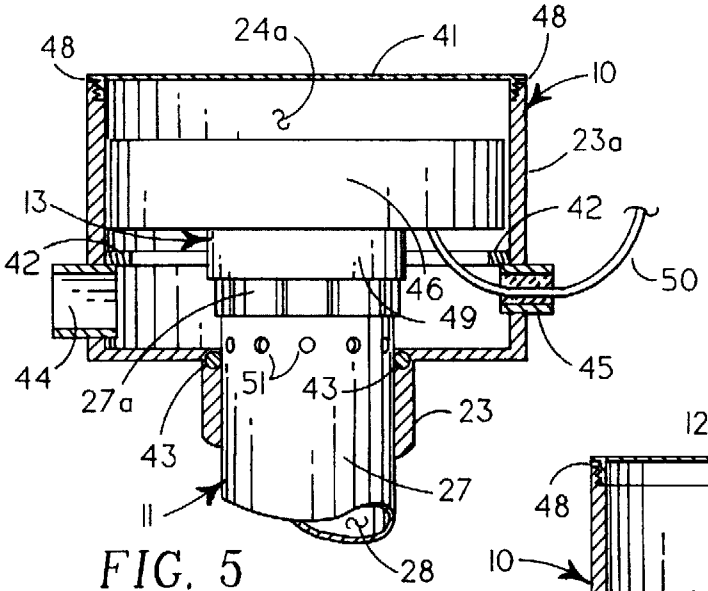
FIG. 5 is a partial vertical cross-sectional view through the upper portion of the injector device of FIG. 4, taken on the line 5—5 thereon in the direction indicated by the arrows.

In the first species of electrically powered fuel injector illustrated in FIGS. 4 and 5, the injector housing in its end part outwardly distal from cylinder head 17 defines diametrically larger cylindrical housing portion 23a having releasably fastenable end cap 41 closing the outer end to define internal chamber portion 24a. The lower medial portion of the radially inner wall of cylindrical body 23a structurally supports annular retaining rim 42 extending radially inwardly to support the lower portion of stator housing 46 of the motor. The lower portion of the internal surface of cylindrical housing portion 23a, at its junction with diametrically smaller injector housing body 23, preferably carries annular sealing gasket 43 to prevent downward passage of pressurized fuel in the chamber 24a past the gasket 43 and between the adjacent surfaces of injector housing 23 and adjacent atomizer casement 11. The housing portion 23a in its lower part defines pressurized fuel input orifice 44 and sealed electric wire orifice 45 to allow passage of fuel and electrical powering wires into the chamber 24a.

Motor stator housing 46 is carried on the upper surface of retaining rim 42 to extend upwardly therefrom to the inner surface of cap 41 for positional maintenance. The upper cylindrical portion 23a of the injector body carries annular gasket 48 at its interconnection with cap 41 to prevent loss of pressurized fuel to the ambient atmosphere and to define a plenum for supply of pressurized fuel to the atomizer casement 11.

The upper portion 27a of the atomizer casement body 27 irrotatably communicates with annular motor rotor 49 journalled within motor stator housing 46 for powered rotation responsive to current supplied through powering lines 50. The upper portion of atomizer casement body 27a within the plenum 24a defines a plurality of circumferentially spaced input ports 51 that allow pressurized fuel in the plenum to pass into the internal chamber 28 of the atomizer casement 11. With this structure the atomizer casement 11 may be rotated relative to the injector housing 10 and the parameters of that rotation may be selectively determined by known external electronic control devices regulating the operation of the electric motor, while pressurized fuel is supplied to the atomizer casement chamber.

Figure 7:
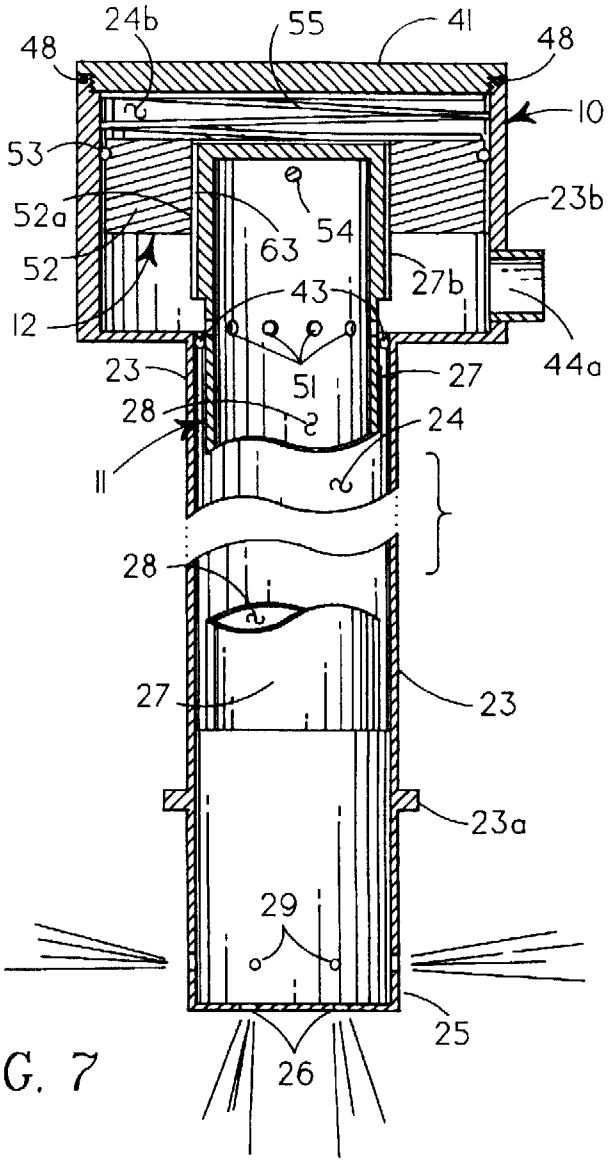
FIG. 7 is a partially cut-away cross-sectional view of a mechanically operated, fuel pressure powered species of injector device.
Figure 8:
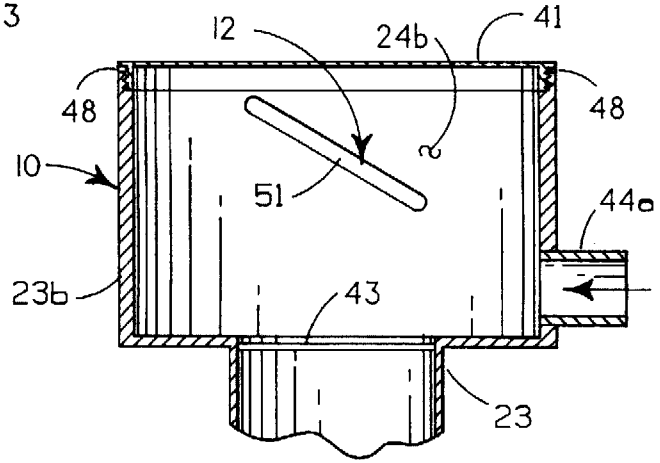
FIG. 8 is a similar cross-sectional view of the upper injector housing of the injector device of FIG. 7, with the atomizer casement and piston removed for illustrative purposes.

A second species of injection device that is powered for atomizer casement rotation by pressurized fuel in the injector housing is illustrated in FIGS. 7 and 8. Here the outer portion of the injector housing 23 defines enlarged cylindrical upper portion 23b that releasably carries end cap 41 to define internal chamber 24b therein for containment of mechanism that rotates the atomizer casement 11. The internal wall of upper housing portion 23b defines similar elongate, diametrically opposed axially angulated channels 51. The lower portion of cylindrical body 23b at its juncture with the diametrically smaller portion of the body 23 provides annular gasket 43 to prevent passage of pressurized fluid therepast in a downward direction toward the nose 25 of the injector. Pressurized fuel input orifice 44a inputs pressurized fuel from exteriorly of the injector housing through body portion 23b and into chamber 24b.

The upper outer portion 27b of the atomizer casement carries piston-like sleeve 52, with sealing ring 53 about the upper portion of the periphery thereof, for axial motion in chamber 24b of the upper portion 23b of the injector housing. The sleeve 52 defines a splined medial channel 52a and the upper portion 27b of the atomizer casement defines a similar operatively interconnecting spline 63 so that the two elements are irrotatably interconnected but may move lineally in an axial direction relative to each other. The two adjacent splined surfaces are configured to interfit in immediate adjacency and may be provided with sealing gaskets (not shown) to prevent the flow of pressured fuel therebetween if necessary.

The sleeve 52 carries opposed diametrically extending pins 54 projecting spacedly outwardly from each side to operatively extend in the opposed channels 51 where the pin end portions are slidably carried. Compression spring 55 extends between the adjacent surfaces of sleeve 52 and cap 41 to bias the sleeve to a lower or inward position nearer the nose 25 of the injector. With this structure when surges of pressurized fuel are presented within the portion of internal chamber 24*a* below the sleeve 52, the sleeve will be moved upwardly and responsively rotated by the pins 54 moving in slots 51 and will be returned to a null lowered position by reason of the bias of spring 55 when the pressure of the fuel is removed to thusly create an oscillatory rotary motion of the atomizer casement 27.

Various other known types of mechanical linkages and apparatus may be used to rotatably move the atomizer casement 11 relative to the injector housing 10 and so long as they accomplish this purpose and may be controlled and regulated as required by our injector device, they are within the ambit and scope of our invention.

Having described the structure of our injection device, its operation may be understood.

An injection device, constructed according to the foregoing specification and provided with means for controllably rotating the atomizer casement 11 relative to the injector housing 10 and a supply of pressurized fuel to be injected, is operatively interconnected in fuel injector port 21 defined in cylinder head 17. The injection device is provided with appropriate power for controlled rotation of the atomizer casement in the injector housing.

As the atomizer casement rotates to appropriate position whereat an exit port 26 defined in injector housing 10 comes into communication with the output channel of an atomizer port 29 defined in the atomizer casement 11, fuel will pass through the swirl atomizer carried in that atomizer port to be injected into the combustion area of cylinder 15.

The timing of this injection process is critical to the operation of our fuel injector, as the fuel must be injected for a relatively short period of time during which the cylinder receiving the fuel is at or near its maximum compression cycle. The timing of the fuel injection process from its inception to cessation in engine operation has been studied and is well known in the literature and by persons skilled in the diesel engine arts. Our invention operates according to those principles heretofore known.

The parameters relating to fuel injection with our injector device may be finely regulated to accomplish various desired results. The time period over which fuel is injected through a particular atomizer port 29 and the volume of that fuel may be regulated firstly by the speed of rotation of atomizer casement 11 relative to injector housing 10. The injection period may be regulated, especially as between various injector housing exit ports 26, by defining selected exit ports as elongate slots extending in the path of rotation of the associated atomizer port 29, so that the two orifices remain in communication for a longer period of time. The volume of injected fuel may also be regulated by orifice sizes.

The portion of a cylinder into which atomized fuel is injected may be determined by the location and orientation of exit ports 26 and associated atomizer ports 29 in the injector nose portion. The ports may be variously arrayed both vertically and radially in the vertical walls of the injector housing and atomizer casement, or in angulated portions of the nose and in the bottom, as illustrated in FIGS. 1, 4 and 7, to accomplish various fuel distribution patterns within a cylinder.

The angulation of the spray cone from orifices may be adjusted, primarily by adjusting the configuration and the dimensioning of the swirl spray atomizers and especially their input and output orifices and swirl chambers and secondarily by adjusting the configuration of exit ports 26 in the injector housing. Swirl spray nozzles in general allow wide variation in the cone angle of their output, varying from small angles of less than fifteen degrees to relatively flat sprays approaching cone angles of sixty degrees or more.

The spray pattern and input timing within a particular cylinder may be further adjusted by using one spray injector nozzle to service a plurality of exit ports 26 in an injector housing by locating those exit ports spacedly along the rotary course of travel of the particular atomizer port with either regular or irregular spacing. Various other arrays might involve a plurality of atomizer ports servicing a plurality of exit ports, either or both variously spaced along a course over which the atomizer ports pass.

By using various permutations and combinations of the dynamic relationships of exit ports and atomizer ports, a wide variety of spray conditions may be created with our fuel injection device to fulfill varying parameters required by particular fuel injection systems. The determination of such parameters is within the skill of a person knowledgeable in the fuel injection arts.

The rotation of the atomizer casement 11 within the injector housing 10 preferably is accomplished by an electrically powered motor, but such rotary motion may be accomplished by various other electrically or mechanically powered means heretofore known. Since the rotary motion often must be selectively variable and quite finely controllable, this generally is best and most simply accomplished by electrical powering which can be finely regulated by known and available control devices of substantial sophistication.

Figure 9:
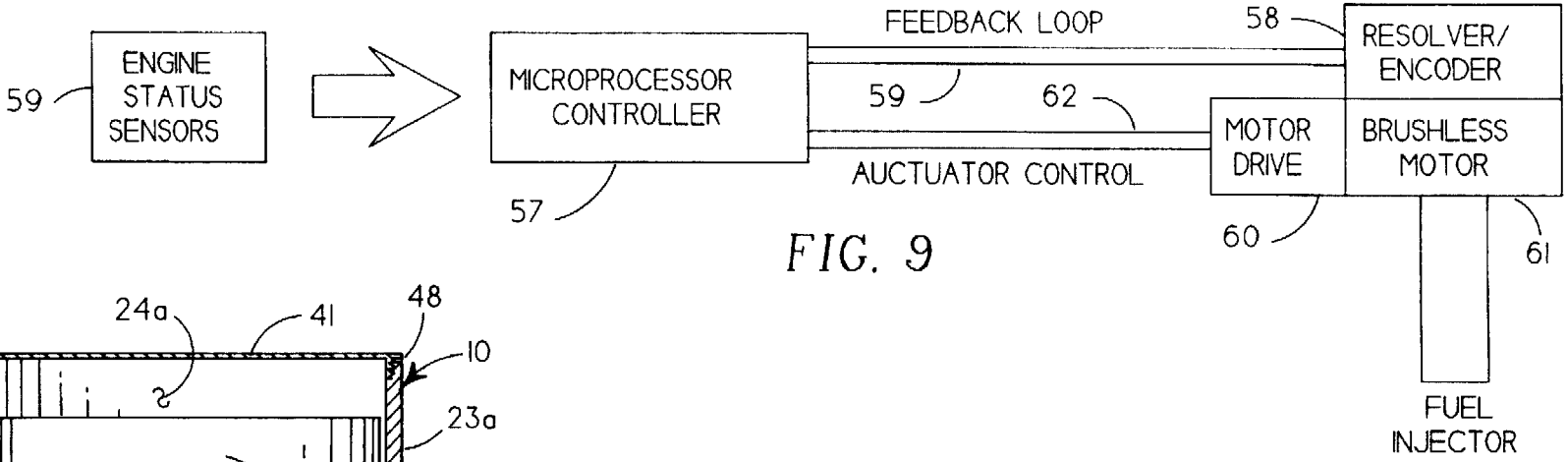
FIG. 9 is a diagrammatic illustration of the operational logic of the electrically powered injection device of FIGS. 4 and 5.
Figure 6:
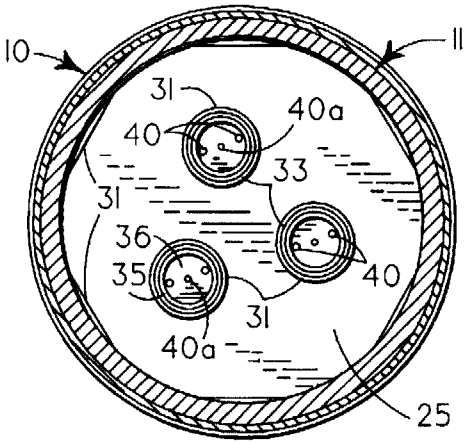
FIG. 6 is a somewhat enlarged horizontal cross-sectional view through the injector device of FIG. 4, taken on the line 6—6 thereon in the direction indicated by the arrows.

The rotation speed and synchronization of the atomizer casement must be related to the cycling of an associated motor cylinder. With an electrically powered drive this may be accomplished by known control systems such as the one illustrated generically in the diagram of FIG. 9. Here engine status sensors 59 provide information to microprocessor controller 57, which in turn receives information from resolver and encoder 58 associated with the injector by feedback loop 59. The microprocessor controller 57 uses this input to control motor drive 60 of brushless motor 61 through actuator control circuit 62. This control of motor driven rotating devices is not new or novel and other similar known control systems for mechanically or hydraulically powered driving mechanism may be used with our injection device and are within its ambit and scope.

The foregoing description of our invention is necessarily of a detailed nature so that specific embodiments of its best known modes might be set forth as required, but it is to be understood that various modifications of detail, rearrangement and multiplication of parts might be resorted to without departing from its spirit, essence or scope.

Having thusly described our invention, what we desire to protect by Letters Patent, and

What we claim is:

1. A device for injecting an atomized spray of liquid fuel into a cylinder of an internal combustion engine, comprising in combination:

an elongate injector housing, having first and second end portions, defining a circularly cylindrical chamber and having means for sealably maintaining the first end portion within an engine cylinder for injection of liquid fuel in the cylinder, at least one exit port defined in the first end portion, and a plenum defined in the second end portion having means for receiving pressurized liquid fuel;

an elongate circularly cylindrical atomizer casement, having first and second end portions, carried for rotation in valving adjacency in the chamber defined in the injector housing, said atomizer casement having a fuel chamber defined therein, at least one atomizer port defined through the first end portion to communicate with at least one exit port defined in the first end portion of the injector housing at at least one rotary position of the atomizer casing relative to the injector housing, swirl spray atomizers carried by the atomizer casement to communicate between the fuel chamber and each atomizer port, and at least one input orifice defined through the second end portion of the atomizer casement communicating with the plenum defined in the second end portion of the injector housing to pass pressurized fuel from the plenum into the fuel chamber defined in the atomizer casement; and means for adjustably rotating the atomizer casement relative to the injector housing to allow a spray of fuel to pass from the exit ports when in communication with an atomizer port.

2. The device of claim 1 wherein the means for rotatably moving the atomizer casement relative to the injector housing comprise:

an electrically powered motor carried by the second end portion of the injector housing to operatively communicate with the second end portion of the atomizer casement for controlled rotation of the atomizer casement.

3. The device of claim 1 wherein the means for rotatably moving the atomizer casement relative to the injector housing comprise:

the plenum at the second end portion of the injector housing defining an annular channel between the second end portions of the injector housing and atomizer casement;

two similar diametrically opposed, axially angulated pin slots defined in the inner surface of the second end portion of the injector housing defining the plenum;

an annular sleeve irrotatably carried about the second end portion of the atomizer casement for axial motion relative to the atomizer casement, said sleeve forming an annular piston in the channel between the second end portions of the injector housing plenum and atomizer casement and having diametrically extending pins communicating with the pin slots defined in the injector housing for sliding motion therein;

spring means for biasing the annular sleeve toward the first end of the atomizer casement; and means for cyclically supplying pressurized fuel in the plenum to move the sleeve away from the first end of the atomizer casement to cause oscillating rotary motion of the atomizer casement relative to the injector housing.

4. The device of claim 1 further characterized by:

plural exit ports defined in the injector housing in circumferentially and axially spaced array, and plural atomizer ports defined in the atomizer casement spacedly arrayed so that each atomizer port communicates with at least one exit port when the injector housing and atomizer casement are in at least one rotary position relative to each other.

5. A device to inject an atomized spray of pressurized liquid fuel into the combustion chamber of the cylinder of an engine, comprising in combination:

an elongate injector housing defining a cylindrical chamber and having first and second end portions, with a fluid plenum having means for input of pressurized liquid fuel in the first end portion, a nose at the second end portion, a plurality of exit ports defined in the nose in axially and circumferentially spaced array, and means for releasably fastening the injector housing in a fuel injector port defined in a cylinder head with the nose at the second end portion of the injector housing communicating with the cylinder;

an elongate cylindrical atomizer casement with first and second end portions carried for rotation in the chamber defined in the injection housing, said atomizer casement having a fuel chamber defined therein, the first end portion extending into the plenum defined in the first end portion of the injector housing and housing means to pass pressurized fuel from the plenum into the chamber defined in the atomizer casement, a configuration similar to and incrementally smaller than the internal chamber defined in the injector housing to allow rotary valving action between the injector housing and the atomizer casement, plural spaced atomizer ports defined in the second end portion and arrayed to communicate with at least one of the exit ports defined in the second end portion of the injector housing at at least one rotary position of the atomizer casement relative to the injector housing, and pressure swirl atomizers carried by the atomizer casement to communicate between the fuel chamber and each atomizer port; and means for adjustably rotating the atomizer casement relative to the injector housing to move at least one atomizer port defined in the atomizer casement into communication with at least one exit port defined in the injector housing to allow a spray of fuel to pass from the exit port during communication of each atomizer port and exit port.

* * * * *